US008690293B2

(12) United States Patent
Komazawa et al.

(10) Patent No.: US 8,690,293 B2
(45) Date of Patent: Apr. 8, 2014

(54) IMAGE FORMING APPARATUS, IMAGE FORMING METHOD, AND COMPUTER READABLE MEDIUM

(75) Inventors: Hisao Komazawa, Kanagawa (JP); Nobuhide Kawabata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 321 days.

(21) Appl. No.: 13/292,446

(22) Filed: Nov. 9, 2011

(65) Prior Publication Data

US 2012/0262510 A1 Oct. 18, 2012

(30) Foreign Application Priority Data

Apr. 13, 2011 (JP) ..... 2011-089201

(51) Int. Cl.
*B41J 2/165* (2006.01)

(52) U.S. Cl.
USPC ..... 347/35

(58) Field of Classification Search
CPC ..... B41J 2002/16529
USPC ..... 347/35
See application file for complete search history.

(56) References Cited

U.S. PATENT DOCUMENTS 5,659,342 A 8/1997 Lund et al.
7,431,420 B2 * 10/2008 Inoue ..... 347/23

FOREIGN PATENT DOCUMENTS

JP A-2002-225301 8/2002
JP 2003127429 * 5/2003 ..... 347/29
JP A-2003-127429 5/2003

OTHER PUBLICATIONS

Nov. 27, 2012 Office Action in Australian Patent Application No. 2011-254091.

* cited by examiner

*Primary Examiner* — Julian Huffman
(74) *Attorney, Agent, or Firm* — Oliff PLC

(57) ABSTRACT

An image forming apparatus includes an ink-ejecting unit, a region dividing unit, and a preparatory ejection unit. The ink-ejecting unit has a recording head aligned in a width direction which is substantially perpendicular to a transport direction of a recording sheet, and ejects ink onto the recording sheet through plural orifices of the recording head in accordance with print data to be printed in response to a print instruction, thereby printing an image. The region dividing unit divides, in the width direction of the recording sheet, a print region of the recording sheet into a user region and a print control region. The preparatory ejection unit preparatorily ejects ink onto the recording sheet through the plural orifices so that an amount of ink ejected through an orifice for the print control region is smaller than an amount of ink ejected through an orifice for the user region.

14 Claims, 12 Drawing Sheets

IMAGE FORMING APPARATUS, IMAGE FORMING METHOD, AND COMPUTER READABLE MEDIUM

CROSS-REFERENCE TO RELATED APPLICATIONS

This application is based on and claims priority under 35 USC 119 from Japanese Patent Application No. 2011-089201 filed Apr. 13, 2011.

BACKGROUND

(i) Technical Field

The present invention relates to an image forming apparatus, an image forming method, and a computer readable medium that efficiently prevent clogging of an ink-ejecting nozzle in a full line recording head provided in an ink-ejecting printing apparatus.

SUMMARY

According to an aspect of the invention, there is provided an image forming apparatus including an ink-ejecting unit, a region dividing unit, and a preparatory ejection unit. The ink-ejecting unit has a full line recording head aligned in a width direction which is substantially perpendicular to a transport direction of a recording sheet, and ejects ink onto the recording sheet through plural orifices of the recording head in accordance with print data to be printed in response to a print instruction, thereby printing an image. The region dividing unit divides, in the width direction of the recording sheet, a print region of the recording sheet into a user region and a print control region. The print data is printed in the user region, and print control information is printed in the print control region. The print control information is referred to in post-processing of the recording sheet. The preparatory ejection unit preparatorily ejects, before printing of the image, ink onto the recording sheet through the plural orifices so that an amount of ink ejected through an orifice for the print control region among the plural orifices is smaller than an amount of ink ejected through an orifice for the user region among the plural orifices.

BRIEF DESCRIPTION OF THE DRAWINGS

Exemplary embodiment(s) of the present invention will be described in detail based on the following figures, wherein.

DETAILED DESCRIPTION

Hereinafter, an exemplary embodiment of the present invention will be described in detail with reference to the attached drawings.

Figure 1:
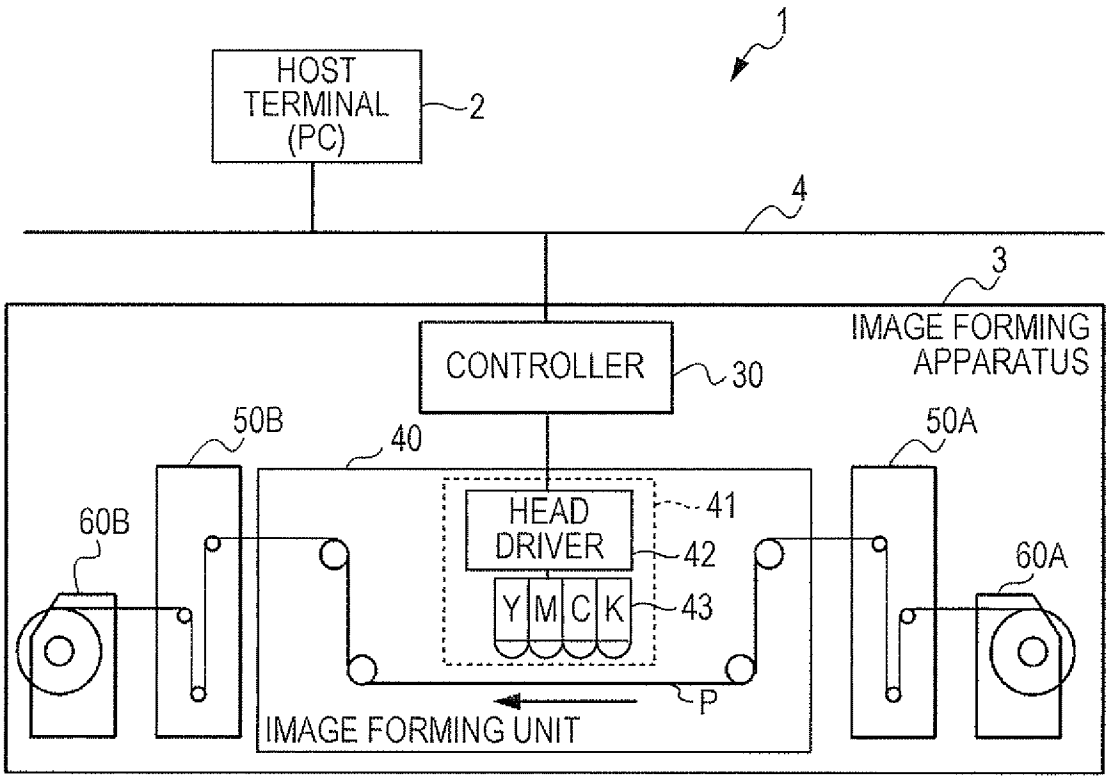
FIG. 1 is a schematic diagram illustrating a configuration of an image forming system according to an exemplary embodiment of the present invention.

FIG. 1 is a diagram illustrating an exemplary schematic configuration of an image forming system 1 according to the exemplary embodiment of the present invention.

In the image forming system 1, a host terminal 2 such as a personal computer (PC) and an image forming apparatus 3 that performs printing at high speed using a continuous sheet P are connected to each other via a network 4 such as a local area network (LAN).

The image forming apparatus 3 is a printing apparatus that prints a print job (for example, a document) on the continuous sheet P at high speed in response to a print instruction provided from the host terminal 2, and includes a recording head 41 of a full line inkjet scheme.

The full line inkjet scheme is a scheme in which printing is performed by fixing a recording head in place and by moving a continuous sheet in a certain direction toward the recording head.

The image forming apparatus 3 includes a controller 30, an image forming unit 40, buffers 50A and 50B, a preprocessor 60A, and a postprocessor 60B. The controller 30 is configured to control the entire image forming apparatus 3 in order to efficiently prevent clogging of ink in the recording head 41 according to the exemplary embodiment.

The image forming unit 40 forms an image on the continuous sheet P transported thereto, and includes the recording head 41 having a head driver 42 and a head unit 43.

The head unit 43 includes ink-ejecting units that eject inks of individual colors (Y, M, C, and K). The head unit 43 has an end portion that faces a sheet transport path, and ejects ink that may be hardened by activation energy onto the continuous sheet P.

The head driver 42 is connected to the head unit 43 and controls the amounts of inks of individual colors that are ejected.

An example of the continuous sheet P for the image forming apparatus 3 may be a roll sheet. The roll sheet is wound around a feeding roller in the preprocessor 60A, and extends from the feeding roller to a winding roller in the postprocessor 60B via the buffer 50A, the sheet transport path in the image forming unit 40, and the buffer 50B.

The buffer 50A applies tension to the roll sheet between the preprocessor 60A and the front end of the sheet transport path in the image forming unit 40. The buffer 50B applies tension to the roll sheet between the postprocessor 60B and the rear end of the sheet transport path in the image forming unit 40.

The continuous sheet P extending in the above-described manner is transported along the sheet transport path in the image forming unit 40 (in the direction indicated by the arrow in FIG. 1) during printing of an image. A print job provided in response to a print instruction is printed on the continuous sheet P through ejection of ink from the head unit 43 in the recording head 41.

The image forming system 1 according to the exemplary embodiment has a functional configuration for preventing clogging of ink in the head unit 43 of the image forming apparatus 3.

Figure 2:
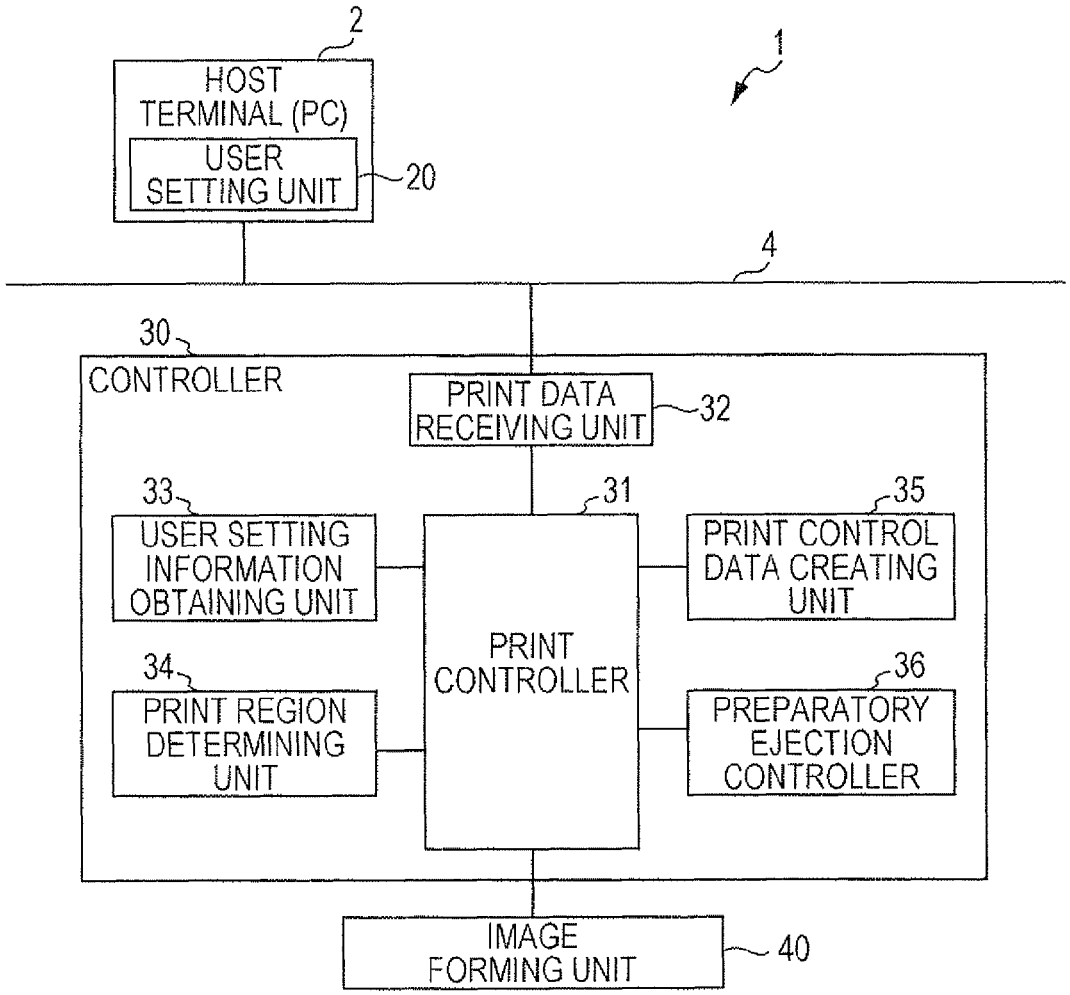
FIG. 2 is a diagram illustrating a functional configuration of individual units of apparatuses constituting the image forming system.

FIG. 2 is a functional block diagram illustrating a functional configuration of the image forming system 1. As illustrated in FIG. 2, the host terminal 2 has a functional configuration of a user setting unit 20. The controller 30 of the image forming apparatus 3 has a functional configuration of a print controller 31, a print data receiving unit 32, a user setting information obtaining unit 33, a print region determining unit 34, a print control data creating unit 35, and a preparatory ejection controller 36.

The user setting unit 20 of the host terminal 2 controls setting of information that may be set by a user in order to efficiently prevent clogging of ink in the head unit 43, and includes various devices for realizing the control.

Hereinafter, an example of a setting screen for allowing a user to set information in the user setting unit 20 will be described with reference to FIG. 3.

Figure 3:
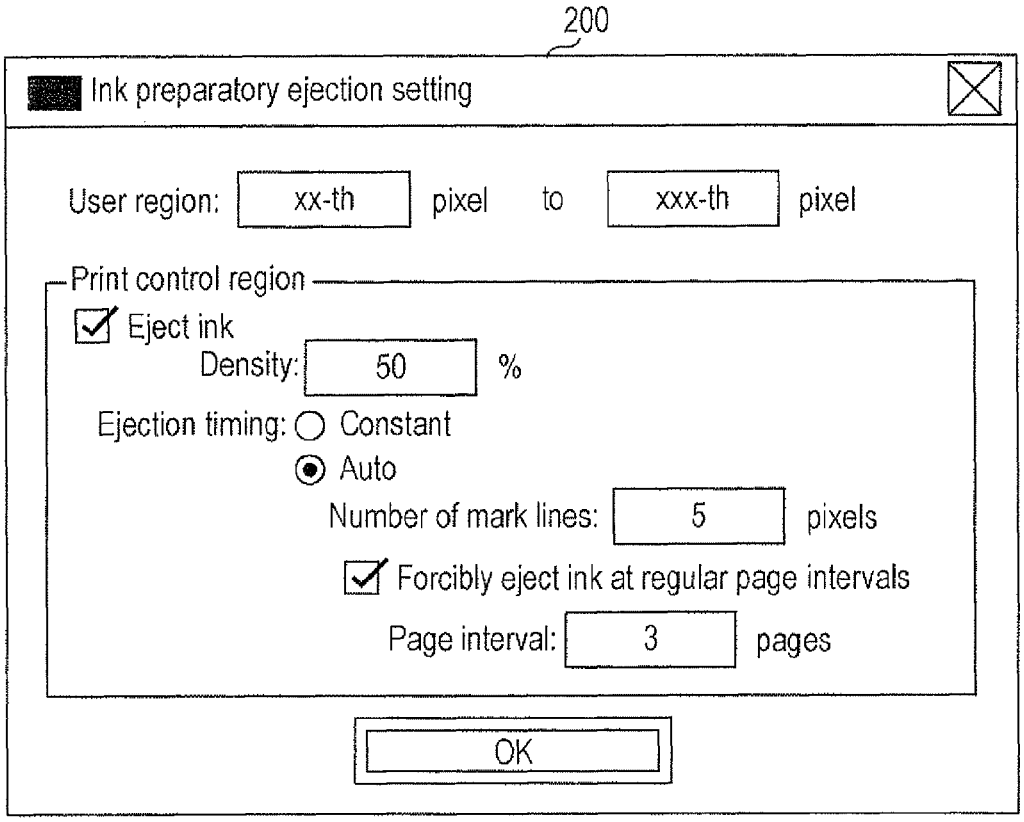
FIG. 3 is a diagram illustrating an exemplary configuration of an ink preparatory ejection setting screen.

FIG. 3 is a diagram illustrating an example of an ink preparatory ejection setting screen 200. The ink preparatory ejection setting screen 200 is a screen used for setting a method for performing preparatory ejection, in which ink is preparatorily ejected before printing print data in response to a print instruction in order to prevent clogging of ink in the head unit 43. The ink preparatory ejection setting screen 200 includes a "user region" item for setting a user region and a print control region in a print region of the continuous sheet P, and a "print control region" item for specifying and setting a method for performing preparatory ejection of ink onto the print control region.

The user region is included in the print region of the continuous sheet P and is a region in which print data to be printed in response to a print instruction provided from a user may be printed. The print control region is a region in which mark images of various control information used for post-processing of the continuous sheet P, such as identification information of the continuous sheet P, cut position information, registration position information, and tandem (front/rear) information, are printed.

Figure 4A:
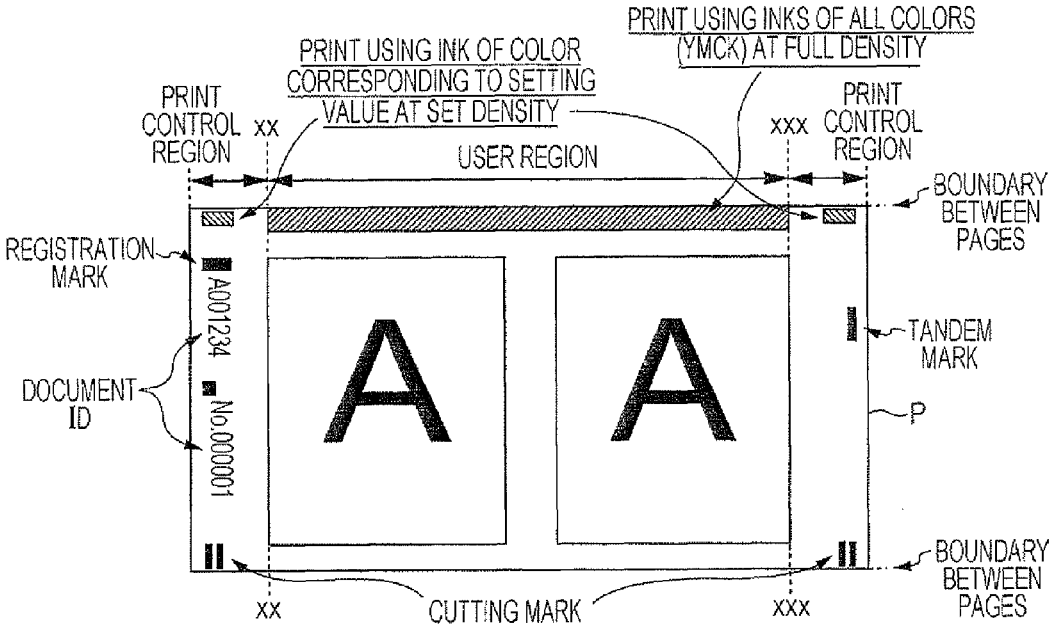
FIGS. 4A and 4B are explanatory diagrams illustrating examples of printing a preparatory ejection image in the image forming system.

For example, it is assumed that "xx-th" pixel to "xxx-th" pixel is input and set in the "user region" item. In this case, as illustrated in FIG. 4A, the image forming apparatus 3 sets a region from the left end of each page on the continuous sheet P to the "(xx−1)-th" pixel as a print control region, sets a region from the "xx-th" pixel to the "xxx-th" pixel as a user region, and sets a region from the "(xxx+1)-th" pixel to the right end of each page on the continuous sheet P as a print control region. The image forming apparatus 3 performs printing by ejecting inks of all colors (Y, M, C, and K) at full density of 100% onto the user region at a boundary between pages on the continuous sheet P, and performs printing by ejecting an ink of the color corresponding to a setting value specified in the "print control region" item at the density set therein onto each print control region.

An ink ejection position corresponding to the total width direction of the continuous sheet P (the direction perpendicular to the transport direction) of the head unit 43 of the full line inkjet scheme may be specified in units of pixels displayed in the "user region" item.

Figure 4B:
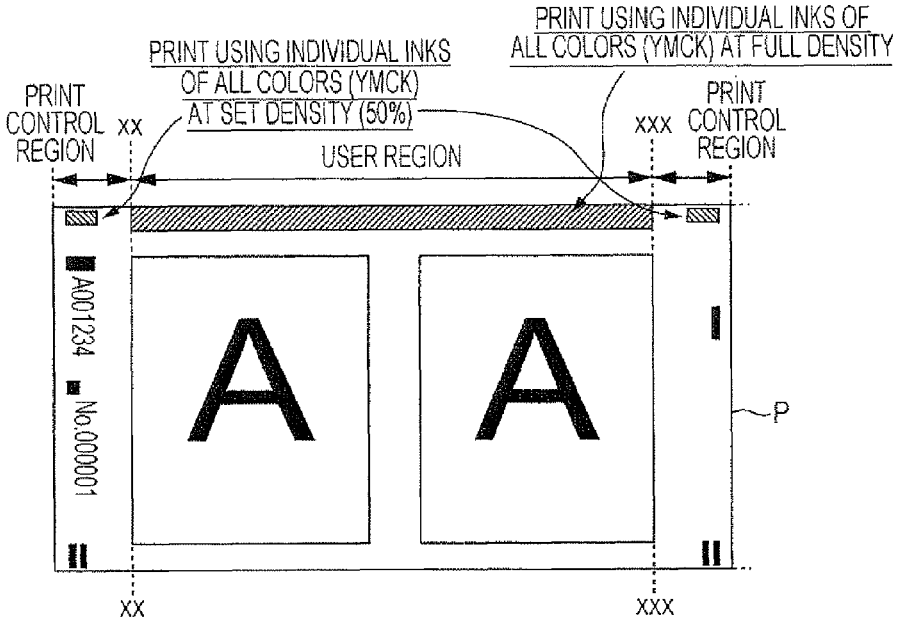

Next, it is assumed that "eject ink" is selected in the "print control region" item, "50%" is input as the "density" item, and "constant" is selected in the "ejection timing" item. In this case, as illustrated in FIG. 4B, if there is a color the ink of which is not ejected for the print control data printed in the print control region (lacking color) among all the colors, printing is performed by ejecting the ink of the lacking color at the set density (in this case, 50%) onto each print control region at the boundary between pages on the continuous sheet P. If there is no lacking color, printing is performed by ejecting inks of all the colors at the set density onto each print control region.

Figure 5A:
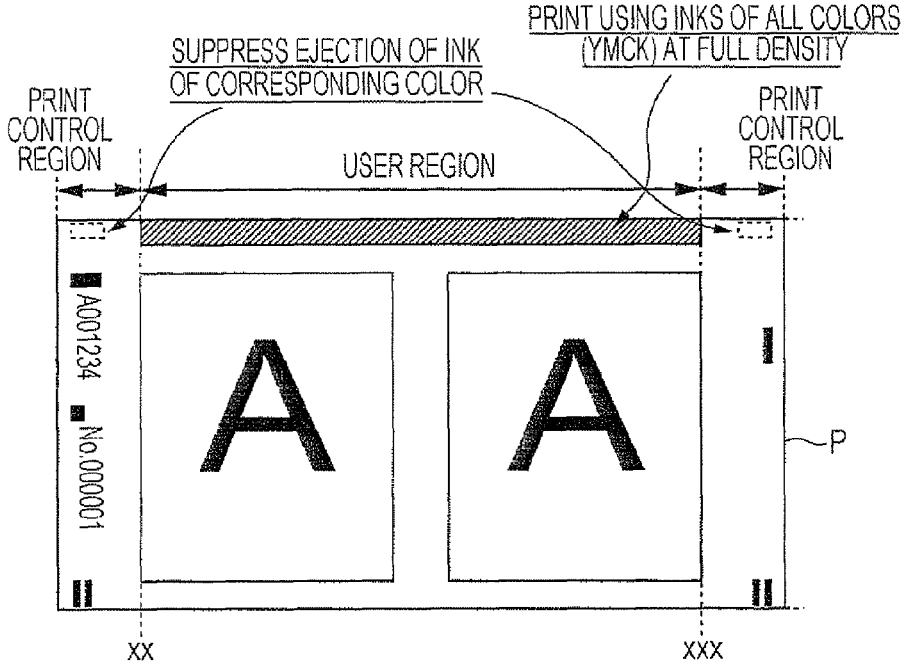
FIGS. 5A and 5B are explanatory diagrams illustrating examples of printing a preparatory ejection image in the image forming system.

Also, it is assumed that "auto" is selected in the "ejection timing" item in the "print control region" item, and "5" pixels is input as the "number of mark lines" item. In this case, as illustrated in FIG. 5A, control is performed so that the ink of the color corresponding to more than "5" pixels as the number of mark lines in the number of lines of print control data is not used for preparatory ejection that is performed on each print control region at the boundary between pages on the continuous sheet P.

An ink ejection position (row) corresponding to the transport direction of the continuous sheet P of the head unit 43 of the full line inkjet scheme may be specified in units of pixels displayed in the "number of mark lines" item.

Figure 5B:
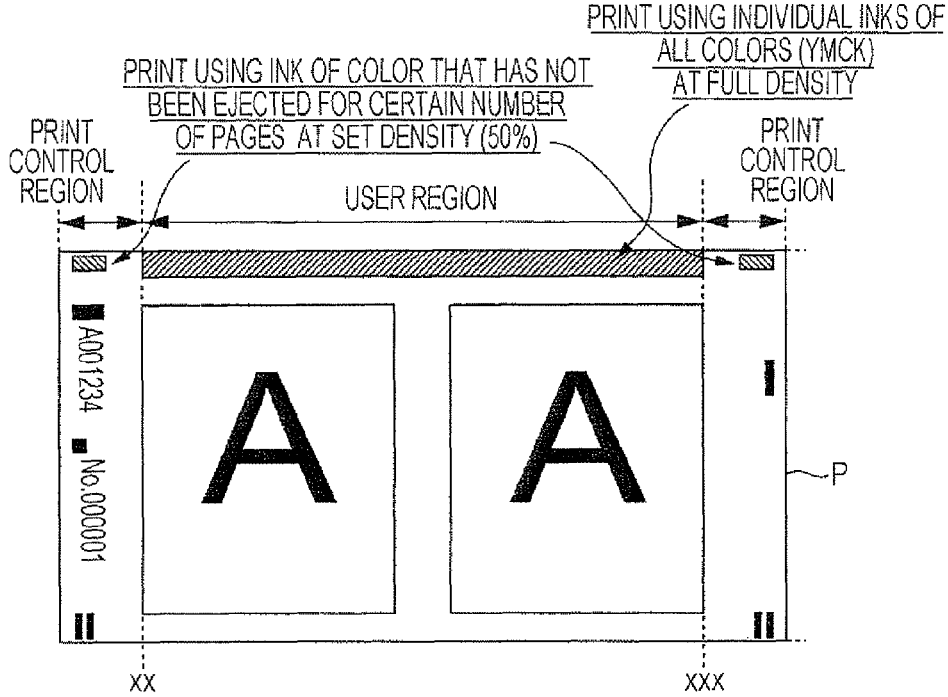

Furthermore, it is assumed that "forcibly eject ink at regular page intervals" is selected in the "print control region" item, and "3" pages is input as the "page interval" item. In this case, as illustrated in FIG. 5B, the image forming apparatus 3 operates so as to perform printing by forcibly ejecting the ink of a color that has not been ejected onto each print control region at the boundary between pages on the continuous sheet P through "3" pages onto the corresponding page on the continuous sheet P at the set density (in this case, 50%).

The print controller 31 of the controller 30 in the image forming apparatus 3 is a functional unit that performs control to instruct the image forming unit 40 to print a created rasterized image and controls the entire image forming apparatus 3 by controlling the individual functional units of the controller 30.

The print data receiving unit 32 is a functional unit that receives a print job. The print job includes print data rasterized and transmitted in response to a print instruction provided from the host terminal 2, user setting information, etc.

The user setting information is various information including individual setting values that are input and set through the above-described ink preparatory ejection setting screen 200 in the host terminal 2.

The user setting information obtaining unit 33 is a functional unit that obtains individual setting values of user setting information included in the print job that is transmitted from the host terminal 2.

The print region determining unit 34 is a functional unit that divides a print region on the continuous sheet P into a user region in which print data is to be printed in response to a print instruction and a print control region in which print control data is to be printed, by referring to the setting values about the user region included in the user setting information obtained by the user setting information obtaining unit 33.

The print control data creating unit 35 is a functional unit that creates print control data and draws it in an image memory (not illustrated), and performs control to notify the preparatory ejection controller 36 of the number of lines (pixel in the column direction and pixel in the row direction) of a mark image corresponding to the drawn print control data.

The preparatory ejection controller 36 is a functional unit that performs control regarding preparatory ejection, for example, control of the amount of ink used for preparatory ejection in the user region and the print control region, the ejection position, and drawing of print data that is to be printed by preparatorily ejecting ink in each region (hereinafter referred to as preparatory ejection print data), on the basis of setting values included in the user setting information obtained by the user setting information obtaining unit 33.

Hereinafter, a control operation for efficiently preventing clogging of ink in the image forming system 1 having the foregoing configuration will be described with reference to the flowcharts illustrated in FIGS. 6 to 8.

First, the operation of the host terminal 2 will be described with reference to the flowchart illustrated in FIG. 6.

Figure 6:
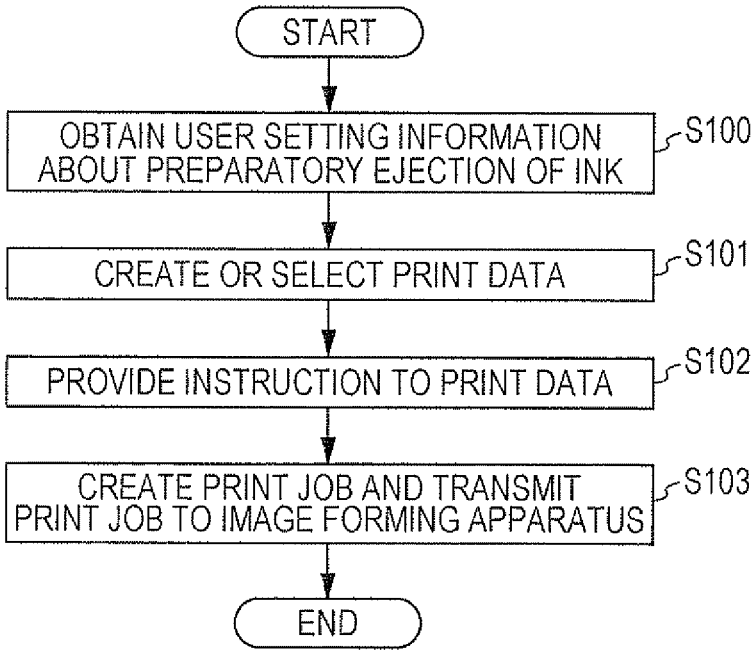
FIG. 6 is a flowchart illustrating operation of a host terminal.

As illustrated in FIG. 6, the host terminal 2 executes the function of the user setting unit 20 in response to an instruction provided by a user, thereby causing the above-described ink preparatory ejection setting screen 200 (see FIG. 3) to be displayed on a screen (not illustrated) of the host terminal 2, causing the user to input individual setting values, and obtaining the setting values as user setting information (step S100).

Then, the user creates or selects print data using the host terminal 2 (step S101) and provides a print instruction (step S102). Accordingly, the host terminal 2 creates a print job including the print data and the user setting information, and transmits the print job to the image forming apparatus 3 (step S103).

Next, the operation of the image forming apparatus 3 will be described with reference to the flowchart illustrated in FIG. 7.

Figure 7:
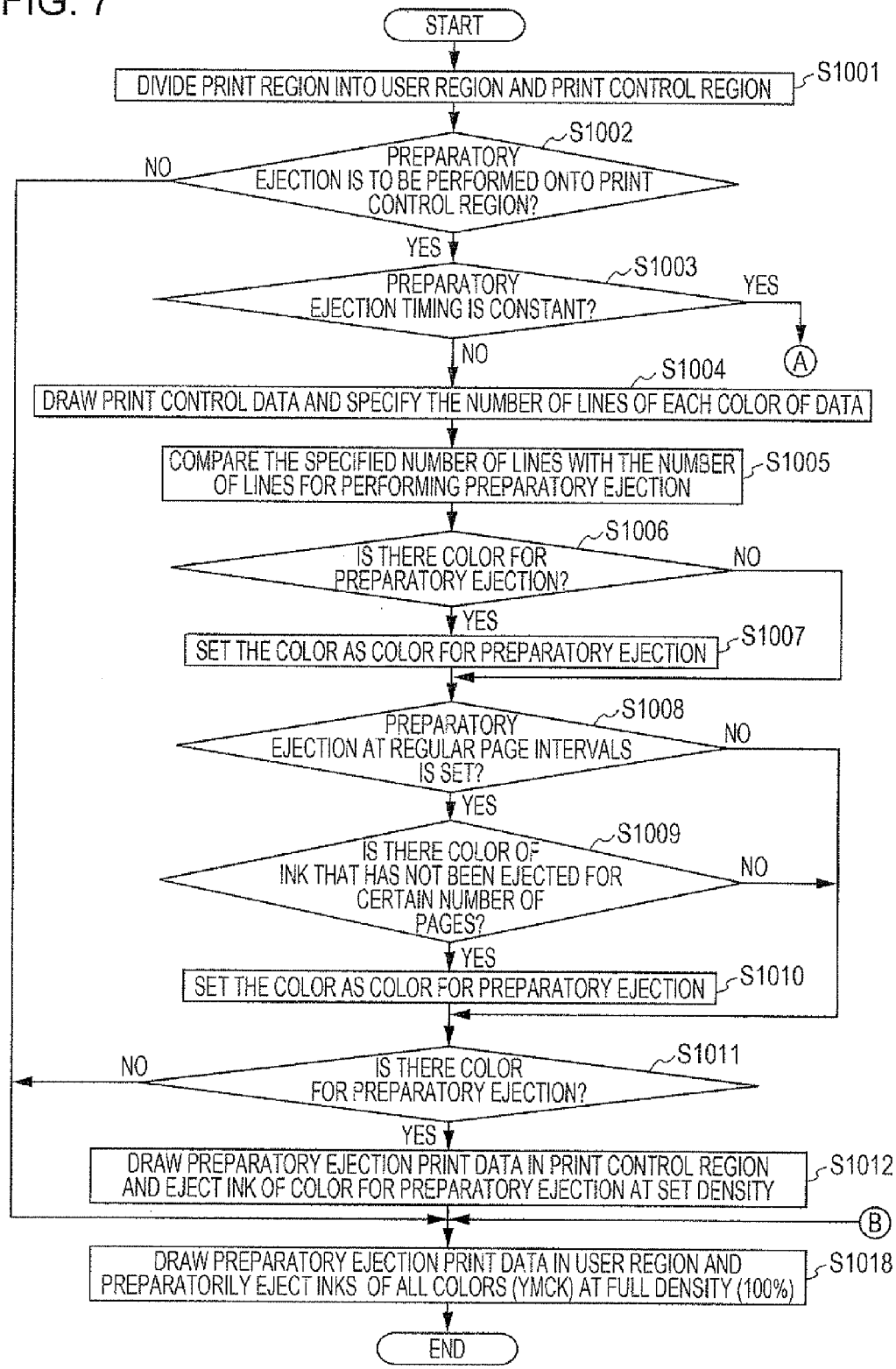
FIG. 7 is a flowchart illustrating operation of an image forming apparatus.
Figure 8:
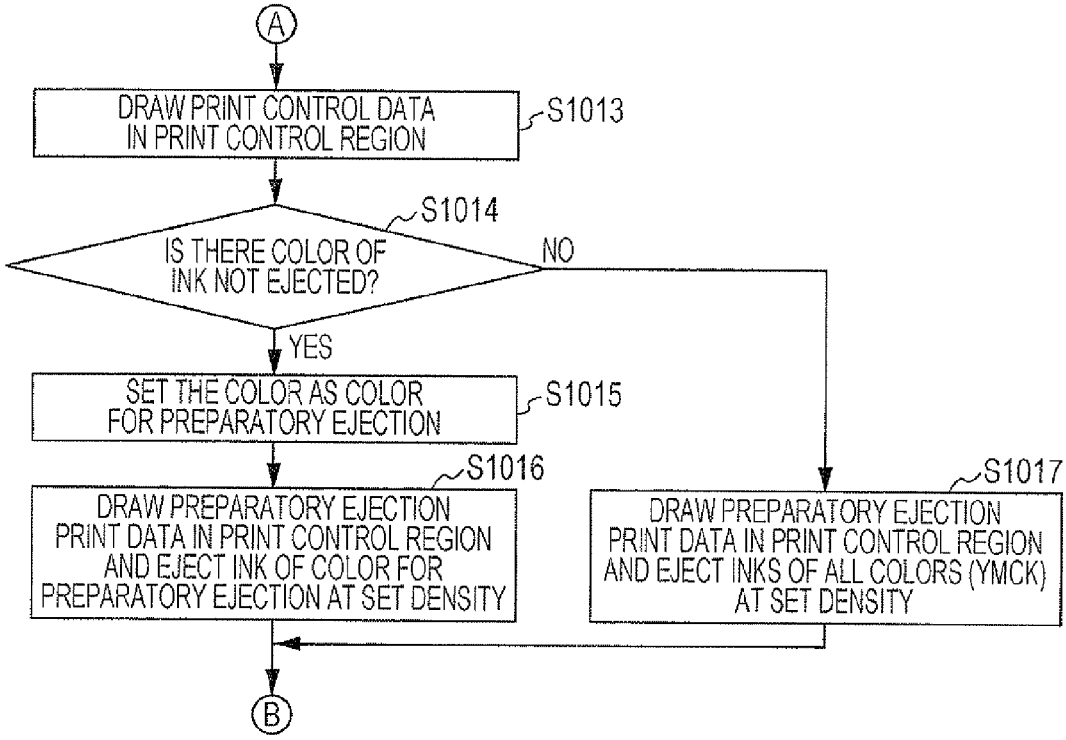
FIG. 8 is a flowchart illustrating operation of the image forming apparatus.

As illustrated in FIG. 7, in the image forming apparatus 3, the print data receiving unit 32 receives the print job transmitted from the host terminal 2 via the network 4, and the user setting information obtaining unit 33 obtains the individual setting values in the user setting information included in the print job.

The print region determining unit 34 divides the region corresponding to the print region on the continuous sheet P in the image memory (not illustrated) into a user region and a print control region by referring to the setting value for the user region included in the user setting information obtained by the user setting information obtaining unit 33 (step S1001).

After the print region is divided into the user region and the print control region in step S1001, the preparatory ejection controller 36 determines whether or not preparatory ejection is to be performed onto the print control region by referring to the setting value about preparatory ejection included in the user setting information obtained by the user setting information obtaining unit 33 (step S1002). If preparatory ejection is not to be performed (NO in step S1002), preparatory ejection print data is drawn in the user region at the boundary between pages on the continuous sheet P in the image memory (not illustrated), and sets all the colors of inks to the ejection target, and the ejection density to full density (100%).

On the basis of the setting values, the print controller 31 performs control of not performing preparatory ejection of ink onto the print control region on the continuous sheet P, but ejecting inks of all the colors only onto the user region to print an image of preparatory ejection print data (step S1018).

On the other hand, if preparatory ejection is to be performed onto the print control region (YES in step S1002), the preparatory ejection controller 36 further determines the ejection timing (constant or auto) on the basis of the setting value included in the user setting information (step S1003).

If the ejection timing is "auto" (NO in step S1003), the preparatory ejection controller 36 requests the print control data creating unit 35 via the print controller 31 to notify the preparatory ejection controller 36 of the color of print control data to be printed in the print control region and the number of lines (rows) of the color. Then, the print control data creating unit 35 draws the print control data in the print control region in the image memory, specifies the color of the drawn print control data and the number of lines (rows) of the color, and notifies the preparatory ejection controller 36 of the color and the number of lines (step S1004).

The preparatory ejection controller 36 compares the specified number of lines with the number of lines for performing preparatory ejection that is defined as a condition for performing preparatory ejection (step S1005). If there is a color having the specified number of lines that is equal to or smaller than the number of lines for performing preparatory ejection, the preparatory ejection controller 36 determines that there is a color for which preparatory ejection is to be performed (YES in step S1006), and sets the color as a color for which preparatory ejection is to be performed (step S1007).

The specified number of lines is obtained in advance and is stored in a storage device (not illustrated) included in the image forming apparatus 3.

If there is no color having the specified number of lines that is equal to or smaller than the number of lines for performing preparatory ejection, it is determined that there is no color for which preparatory ejection is to be performed (NO in step S1006). After that, or after the color for which preparatory ejection is to be performed is set in step S1007, it is determined on the basis of the setting value included in the user setting information whether or not "forcibly eject ink at regular page intervals" is selected (step S1008).

If the setting value included in the user setting information indicates "forcibly eject ink at regular page intervals" (YES in step S1008), it is determined whether or not there is a color of ink that has not been ejected for the set number of pages (step S1009). If there is such a color (YES in step S1009), the color is set as a color for which preparatory ejection is to be performed (step S1010).

If it is determined in step S1008 that the setting value included in the user setting information does not indicate "forcibly eject ink at regular page intervals" (NO in step S1008), or if it is determined in step S1009 that there is no color for which ink has not been ejected for the set number of pages (NO in step S1009), or after setting the color for which preparatory ejection is to be performed in step S1010, it is determined whether or not there is a color for which preparatory ejection is to be performed (step S1011). If there is a color for which preparatory ejection is to be performed (YES in step S1011), preparatory ejection print data is drawn in the print control region and the user region at the boundary between pages on the continuous sheet P in the image memory (not illustrated).

Then, the print controller 31 ejects the ink of the color for which preparatory ejection is to be performed, that is, the ink of the color set in steps S1007 and S1010, onto the print control region on the continuous sheet P at the set density (for example, 50%), thereby printing an image of preparatory ejection print data (YES in step S1011 and the process proceeds to step S1012), and also ejects the inks of all the colors onto the user region at full density, thereby printing an image of preparatory ejection print data (step S1018).

If it is determined in step S1011 that there is no color for which preparatory ejection is to be performed (NO in step S1011), the print controller 31 does not perform preparatory ejection of ink onto the print control region on the continuous sheet P, but ejects inks of all the colors onto only the user region at full density, thereby printing an image of preparatory ejection print data (step S1018).

If it is determined in step S1003 that the setting value included in the user setting information indicates that the ejection timing is "constant" (YES in step S1003), the print control data creating unit 35 draws print control data in the print control region in the image memory (step S1013 in FIG. 8), and determines whether or not there is a color the ink of which has not been ejected in the drawn print control data (lacking color) among all the colors (step S1014). Then, the print control data creating unit 35 notifies the preparatory ejection controller 36 of the determination result. If there is a lacking color, the print control data creating unit 35 specifies the color and notifies the preparatory ejection controller 36 of the color.

If a notification indicating that there is a lacking color is transmitted from the print control data creating unit 35 (YES in step S1014), the preparatory ejection controller 36 draws preparatory ejection print data in the print control region and the user region at the boundary between pages on the continuous sheet P in the image memory (not illustrated). The preparatory ejection controller 36 sets the lacking color as the color for ejection and sets the density of ink to be ejected to set density (for example, 50%) in the print control region. Also, the preparatory ejection controller 36 sets all the colors as the colors for ejection and sets the density of ink to be ejected to full density in the user region.

On the basis of the setting values, the print controller 31 performs control so as to eject ink of the lacking color of the print control data at the set density, thereby printing an image of preparatory ejection print data in the print control region at the boundary between pages on the continuous sheet P, and to eject inks of all the colors at full density, thereby printing an image of preparatory ejection print data in the user region (steps S1015 to S1016 and S1018).

If a notification indicating that there is no lacking color is transmitted from the print control data creating unit 35 (NO in step S1014), the preparatory ejection controller 36 draws preparatory ejection print data in the print control region and the user region at the boundary between pages on the continuous sheep P in the image memory (not illustrated). The preparatory ejection controller 36 sets all the colors as the colors for ejection and sets the density of ink to be ejected to the set density (for example, 50%) in the print control region. Also, the preparatory ejection controller 36 sets all the colors as the colors for ejection and sets the density of ink to be ejected to full density in the user region.

Then, on the basis of the setting values, the print controller 31 performs control so as to eject inks of all the colors onto the print control region on the continuous sheet P at the set density, thereby printing an image of preparatory ejection print data, and to eject inks of al the colors onto the user region at full density, thereby printing an image of preparatory ejection print data (steps S1017 and S1018).

In addition to the setting of the timing of preparatory ejection of ink described above, the position of preparatory ejection may be specified and set.

Figure 9:
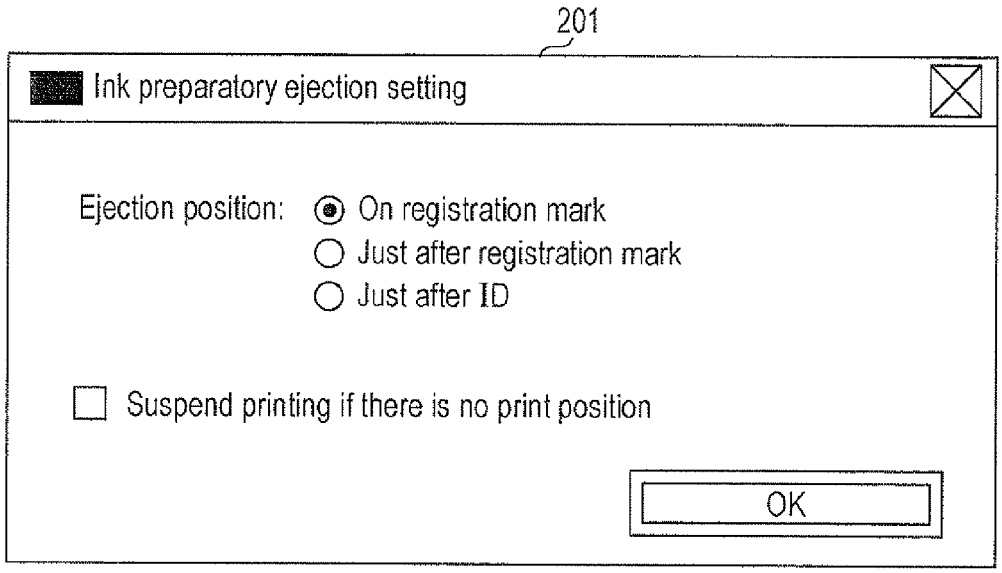
FIG. 9 is a diagram illustrating an exemplary configuration of an ink preparatory ejection setting screen.

In that case, the user setting unit 20 of the host terminal 2 is configured to display an ink preparatory ejection setting screen 201 illustrated in FIG. 9, in addition to the above-described ink preparatory ejection setting screen 200. The ink preparatory ejection setting screen 201 includes selection items "on registration mark", "just after registration mark", and "just after ID", and a selection item "Suspend printing if there is no print position" for suspending a printing process if a region for preparatory ejection (print position) corresponding to the foregoing selection items is not specified. Accordingly, individual setting values may be set.

The ink preparatory ejection setting screen 201 may be provided on the next page of the ink preparatory ejection setting screen 200. Alternatively, the setting items on the ink preparatory ejection setting screen 201 may be additionally provided on the ink preparatory ejection setting screen 200.

The ink preparatory ejection setting screen 201 includes the selection items "on registration mark", "just after registration mark", and "just after ID", which serve as setting items for specifying the position of preparatory ejection, and an error processing item "suspend printing if there is no print position" for specifying a process that is performed when an ejection position is not specified.

Figure 10A:
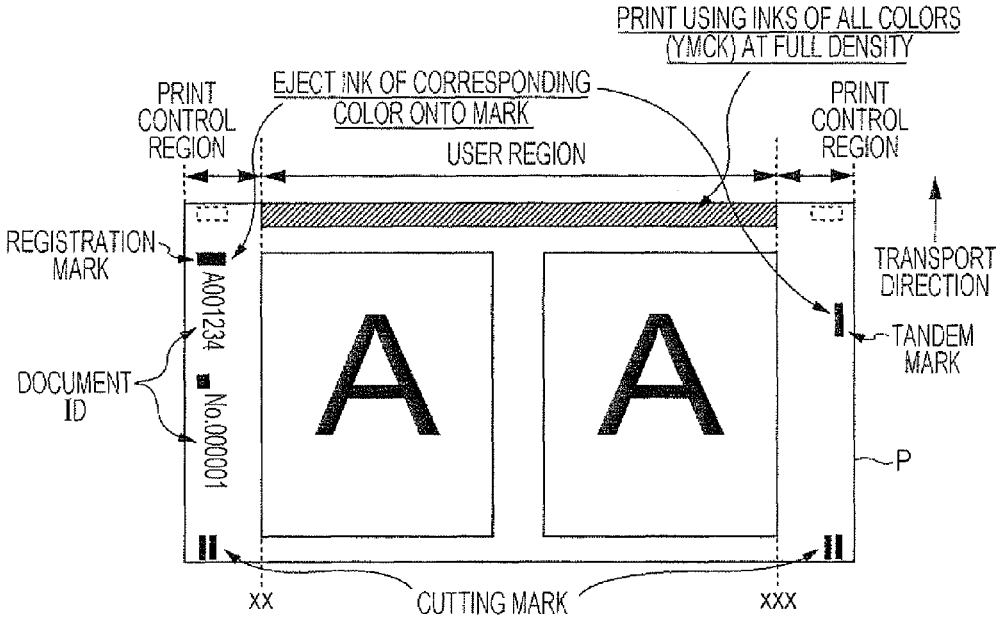
FIGS. 10A and 10B are explanatory diagrams illustrating examples of printing a preparatory ejection image in the image forming system.

It is assumed that "on registration mark" is selected and set as the "ejection position" item on the ink preparatory ejection setting screen 201. In this case, if a registration mark exists in the print control region, the image forming apparatus 3 ejects ink onto the position of the registration mark, as illustrated in FIG. 10A. If no registration mark exists, the image forming apparatus 3 ejects ink of the corresponding color at the specified ejection timing (constant or auto) to perform printing at the specified density in the print control region at the boundary between pages on the continuous sheet P, and ejects inks of all the colors to print an image of preparatory ejection print data at full density in the user region.

In the case of printing another piece of print control data in the print control region, printing may be performed by ejecting ink of the corresponding color at the ink ejection density specified at the position of the mark of the piece of print control data at the specified ejection timing (constant or auto).

Figure 10B:
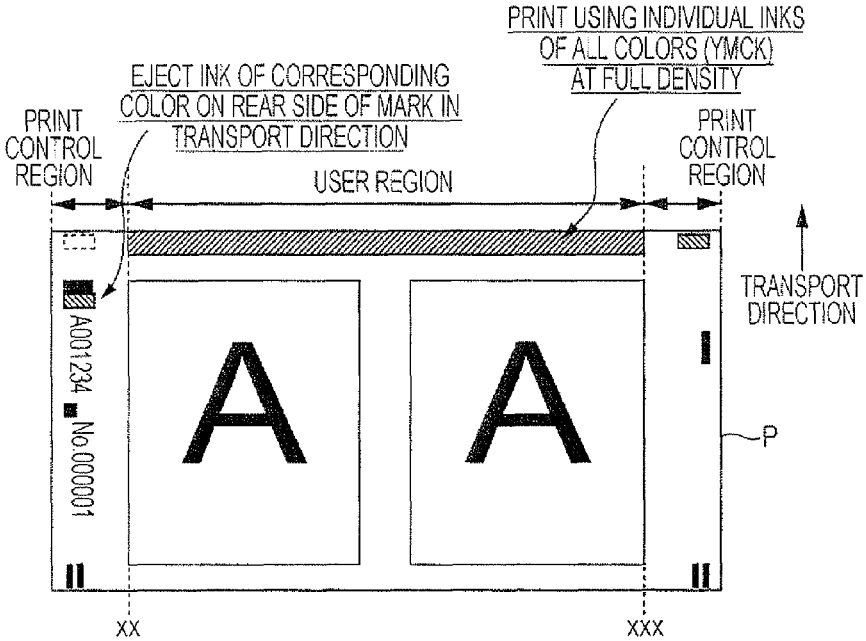

It is assumed that "just after registration mark" is selected and set as the "ejection position" item. In this case, if a registration mark exists in the print control region, the image forming apparatus 3 ejects ink onto the position just after the registration mark (after the registration mark in the transport direction of the continuous sheet P), as illustrated in FIG. 10B. If no registration mark exists, the image forming apparatus 3 ejects ink of the corresponding color at the specified ejection timing (constant or auto) to perform printing at the specified density in the print control region at the boundary between pages on the continuous sheet P, and ejects inks of all the colors to print an image of preparatory ejection print data at full density in the user region.

In the case of printing another piece of print control data in the print control region, printing may be performed by ejecting ink of the corresponding color at the ink ejection density specified at the position of the mark of the piece of print control data at the specified ejection timing (constant or auto).

Figure 11:
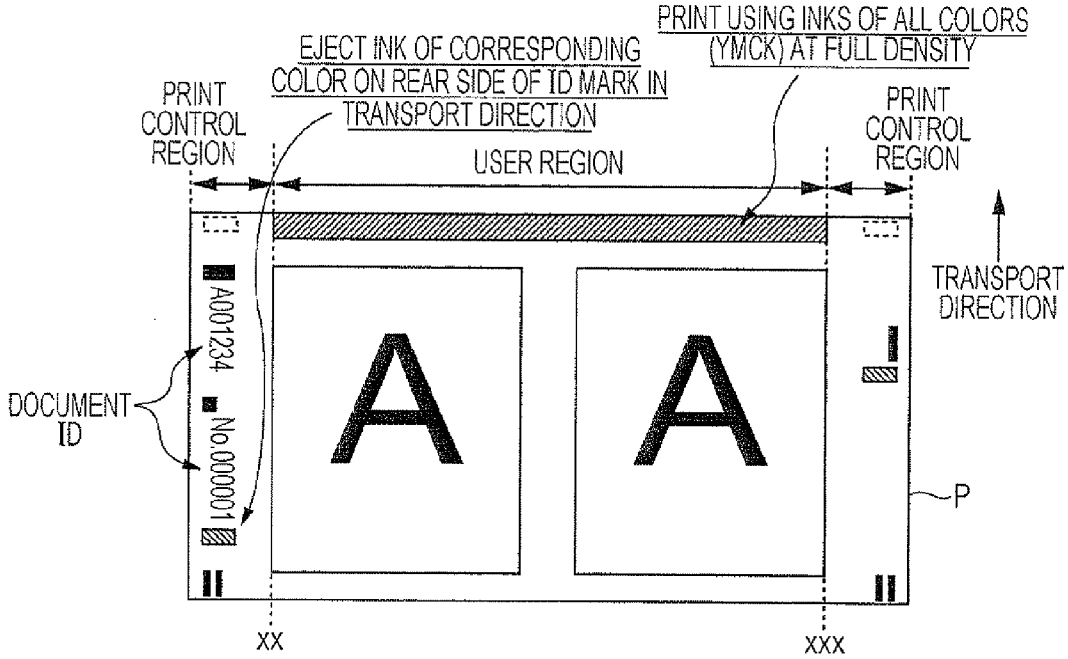
FIG. 11 is an explanatory diagram illustrating an example of printing a preparatory ejection image in the image forming system.

It is assumed that "just after ID mark" is selected and set as the "ejection position" item. In this case, if a document ID mark exists in the print control region, the image forming apparatus 3 ejects ink onto the position just after the document ID mark (after the document ID mark in the transport direction of the continuous sheet P), as illustrated in FIG. 11. If no document ID mark exists, the image forming apparatus 3 ejects ink of the corresponding color at the specified ejection timing (constant or auto) to perform printing at the specified density in the print control region at the boundary between pages on the continuous sheet P, and ejects inks of all the colors to print an image of preparatory ejection print data at full density in the user region.

In a case where "suspend printing if there is no print position" is selected and set, if a region for preparatory ejection (print position) is not specified in the print control region on the continuous sheet P, the image forming apparatus 3 notifies the user of the fact and suspends the printing process.

Hereinafter, the control operation of the host terminal 2 and the image forming apparatus 3 in the above-described case will be described.

Here, the control operation of the individual apparatuses corresponding to a specified ejection position will be described.

As for the operation of the host terminal 2, as in the case of the above-described image forming system 1 according to the exemplary embodiment, the host terminal 2 executes the function of the user setting unit 20 in response to an instruction provided from a user, displays the foregoing ink preparatory ejection setting screen 201 (see FIG. 9) on the screen (not illustrated) of the host terminal 2, allows the user to input individual setting values, and obtains the setting values as user setting information.

Then, the user creates or selects print data using the host terminal 2, and provides a print instruction. Accordingly, the host terminal 2 creates a print job including the print data and the user setting information, and transmits the print job to the image forming apparatus 3.

Figure 12:
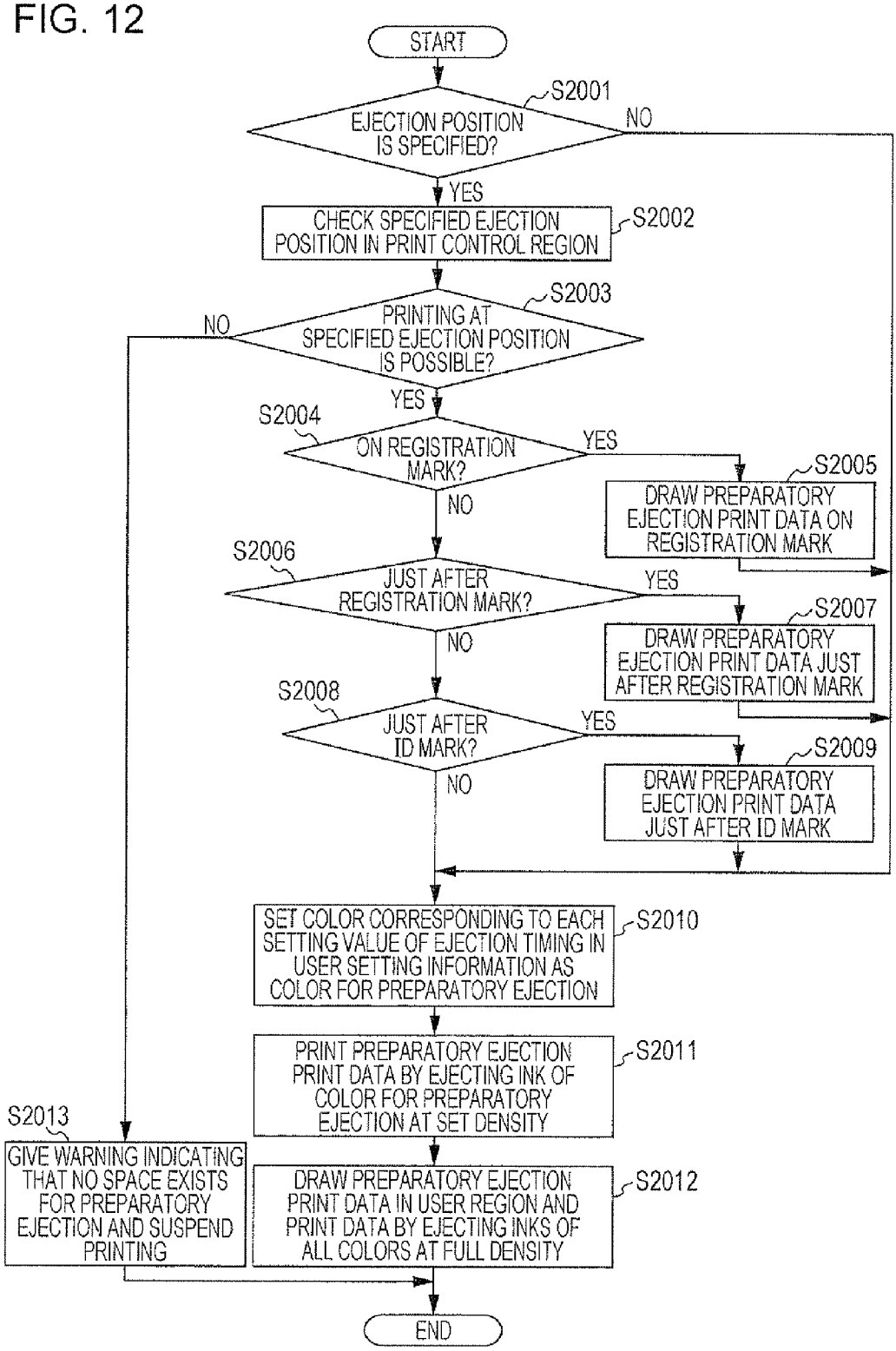
FIG. 12 is a flowchart illustrating operation of the image forming apparatus.

Hereinafter, the operation of the image forming apparatus 3 will be described with reference to the flowchart illustrated in FIG. 12. The preparatory ejection controller 36 refers to the setting value about the ejection position included in the user setting information obtained by the user setting information obtaining unit 33. If the setting value indicates that the ejection position is not specified (NO in step S2001), the preparatory ejection controller 36 draws preparatory ejection print data in the print control region and the user region at the boundary between pages on the continuous sheet P in the image memory (not illustrated), and sets the ink of the color corresponding to each setting value of the ejection timing included in the user setting information ("whether or not preparatory ejection is to be performed", "timing of preparatory ejection (constant or auto)", "the number of mark lines", "forcibly eject ink at regular page intervals", and "page intervals") as the color for preparatory ejection.

On the basis of the setting values, the print controller 31 performs control to eject ink of the color for preparatory ejection corresponding to each setting value of the ejection timing onto the print control region on the continuous sheet P at the set density, thereby printing an image of preparatory ejection print data, and to eject inks of all the colors onto the user region at full density, thereby printing an image of preparatory ejection print data (steps S2010 to S2012).

If it is determined in step S2001 that the setting value indicates that the ejection position is specified in the user setting information (YES in step S2001), the preparatory ejection controller 36 checks the specified preparatory ejection position on the basis of the print control data in the print control region drawn by the print control data creating unit 35 (step S2002), and determines whether or not preparatory ejection print data may be printed at the preparatory ejection position (step S2003).

The checking of the preparatory ejection position is performed in the following manner. That is, the setting value corresponding to any one of "on the registration mark", "just after registration mark", and "just after ID", which is selected and set on the ink preparatory ejection setting screen 201 (see FIG. 9), is set as the user setting information. The preparatory ejection position is checked on the basis of the setting value and the print control data that is drawn.

If it is determined in step S2003, on the basis of the result of checking the specified preparatory ejection position, that preparatory ejection print data may not be printed at the preparatory ejection position (NO in step S2003), the preparatory ejection controller 36 notifies the print controller 31 of the determination result. Accordingly, the print controller 31 notifies the user of the determination result using a notification unit (not illustrated), and suspends and ends the printing process (step S2013).

If it is determined in step S2003 that preparatory ejection print data may be printed at the preparatory ejection position (YES in step S2003), the preparatory ejection controller 36 refers to the setting value about the ejection position included in the user setting information. If the setting value indicates "on registration mark" (YES in step S2004), the preparatory ejection controller 36 draws preparatory ejection print data at the position of the registration mark in the print control region in the image memory (not illustrated) and the user region at the boundary between pages on the continuous sheet P in the image memory, and sets the color corresponding to each setting value of the ejection timing included in the user setting information to the color for preparatory ejection (steps S2005 and S2010).

Then, on the basis of the setting value, the print controller 31 performs control to eject ink of the color for preparatory ejection corresponding to each setting value of the ejection timing onto the print control region on the continuous sheet P at the set density so that the ink is applied onto the registration mark, and to eject inks of all the colors onto the user region at full density to print an image of preparatory ejection print data (steps S2011 and S2012).

If the setting value about the ejection position included in the user setting information indicates "just after registration mark" (NO in step S2004, YES in step S2006), the preparatory ejection controller 36 draws preparatory ejection print data at the position just after the registration mark in the print control region in the image memory (not illustrated) and in the user region at the boundary between pages on the continuous sheet P in the image memory, and sets the color corresponding to each setting value of the ejection timing included in the user setting information to the color for preparatory ejection (steps S2007 and S2010).

Then, on the basis of the setting value, the print controller 31 performs control to eject ink of the color for preparatory ejection corresponding to each setting value of the ejection timing onto the print control region on the continuous sheet P at the set density so that the ink is applied onto the position just after the registration mark, thereby printing an image of preparatory ejection print data, and to eject inks of all the colors onto the user region at full density, thereby printing an image of preparatory ejection print data (steps S2011 and S2012).

If the setting value about the ejection position included in the user setting information indicates "just after ID" (NO in step S2006, YES in step S2008), the preparatory ejection controller 36 draws preparatory ejection print data at the position just after the document ID mark in the print control region in the image memory (not illustrated) and in the user region at the boundary between pages on the continuous sheet P in the image memory, and sets the color corresponding to each setting value of the ejection timing included in the user setting information to the color for preparatory ejection (steps S2009 and S2010).

Then, on the basis of the setting value, the print controller 31 performs control to eject ink of the color for preparatory ejection corresponding to each setting value of the ejection timing onto the print control region on the continuous sheet P at the set density so that the ink is applied onto the position just after the document ID mark, thereby printing an image of preparatory ejection print data, and to eject inks of all the colors onto the user region at full density, thereby printing an image of preparatory ejection print data (steps S2011 and S2012).

In the above-described exemplary embodiment of the present invention, the functional configuration of the user setting unit 20 is included in the host terminal 2. Alternatively, the user setting unit 20 may be included in the image forming apparatus 3.

All or some of the functions of the individual functional units of the apparatuses described above in the exemplary embodiment may be constituted by a computer executable program.

In that case, programs of all or some of the functions of the respective functional units of the host terminal 2 and the controller 30 of the image forming apparatus 3 according to the exemplary embodiment are stored in the storage devices of the respective apparatuses, and the individual programs are read and executed by the central processing units of the respective apparatuses. Accordingly, all or some of the above-described functions according to the exemplary embodiment are realized.

If the functional configuration of the user setting unit 20 is included in the image forming apparatus 3, a program of all or some of the functions of the respective functional units of the host terminal 2 and the controller 30 of the image forming apparatus 3 according to the exemplary embodiment is stored in the storage device of the image forming apparatus 3, and the central processing unit of the image forming apparatus 3 reads and executes the program. Accordingly, all or some of the above-described functions according to the exemplary embodiment are realized.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an ink-ejecting unit that has a full line recording head aligned in a width direction which is substantially perpendicular to a transport direction of a recording sheet and that ejects ink onto the recording sheet through a plurality of orifices of the recording head in accordance with print data to be printed in response to a print instruction, thereby printing an image;

a region dividing unit that divides, in the width direction of the recording sheet, a print region of the recording sheet into a user region and a print control region, the print data being printed in the user region, print control information being printed in the print control region, the print control information being referred to in post-processing of the recording sheet; and a preparatory ejection unit that preparatorily ejects, before printing of the image, ink onto the recording sheet through the plurality of orifices so that an amount of ink ejected through an orifice for the print control region among the plurality of orifices is smaller than an amount of ink ejected through an orifice for the user region among the plurality of orifices.

2. The image forming apparatus according to claim 1, further comprising:

a specifying unit that causes a user to specify whether or not ink is to be ejected to the print control region at the time of preparatory ejection, wherein the preparatory ejection unit ejects ink through the orifice for the print control region in accordance with a specification result generated by the specifying unit.

3. The image forming apparatus according to claim 2, wherein the specifying unit causes the user to specify whether or not to perform suppression of ejection of ink in which a certain amount or more of ink is ejected to print the print control information, and wherein, if suppression of ejection of the ink is specified in the specifying unit, the preparatory ejection unit specifies, among the plurality of orifices, an orifice for the print control region through which the certain amount or more of ink is to be ejected, and suppresses ejection of ink through the specified orifice.

4. The image forming apparatus according to claim 3, further comprising:

a printing process stop unit that makes, if an orifice corresponding to an ejection position specified in the specifying unit in the print control region among the plurality of orifices is not specified by the preparatory ejection unit, a notification indicating that the orifice is not specified, and that stops a process of printing the print data.

5. The image forming apparatus according to claim 2, wherein the specifying unit causes the user to specify whether or not to forcibly eject ink that has not been ejected to the print control region for a transport period of a certain number of pages of the recording sheet, and wherein, if forcible ejection of the ink is specified in the specifying unit, the preparatory ejection unit specifies, among the plurality of orifices, an orifice for the print control region through which no ink has been ejected for the transport period, and ejects ink onto the recording sheet of a corresponding page through the specified orifice.

6. The image forming apparatus according to claim 5, further comprising:

a printing process stop unit that makes, if an orifice corresponding to an ejection position specified in the specifying unit in the print control region among the plurality of orifices is not specified by the preparatory ejection unit, a notification indicating that the orifice is not specified, and that stops a process of printing the print data.

7. The image forming apparatus according to claim 2, wherein the specifying unit causes the user to specify an ejection position in the print control region to which ink is to be preparatorily ejected, and wherein the preparatory ejection unit specifies, among the plurality of orifices, an orifice corresponding to the ejection position in the print control region specified in the specifying unit, and ejects ink through the specified orifice.

8. The image forming apparatus according to claim 7, wherein, if the ejection position specified in the specifying unit overlaps an image of the print control information, the preparatory ejection unit specifies, among the plurality of orifices, an orifice corresponding to the specified ejection position in the print control region, and ejects ink through the specified orifice.

9. The image forming apparatus according to claim 8, further comprising:

a printing process stop unit that makes, if an orifice corresponding to the ejection position specified in the specifying unit in the print control region among the plurality of orifices is not specified by the preparatory ejection unit, a notification indicating that the orifice is not specified, and that stops a process of printing the print data.

10. The image forming apparatus according to claim 7, wherein, if the ejection position specified in the specifying unit is located after an image of the print control information in the transport direction, the preparatory ejection unit specifies, among the plurality of orifices, an orifice corresponding to the specified ejection position in the print control region, and ejects ink through the specified orifice.

11. The image forming apparatus according to claim 10, further comprising:

a printing process stop unit that makes, if an orifice corresponding to the ejection position specified in the specifying unit in the print control region among the plurality of orifices is not specified by the preparatory ejection unit, a notification indicating that the orifice is not specified, and that stops a process of printing the print data.

12. The image forming apparatus according to claim 7, further comprising:

a printing process stop unit that makes, if an orifice corresponding to the ejection position specified in the specifying unit in the print control region among the plurality of orifices is not specified by the preparatory ejection unit, a notification indicating that the orifice is not specified, and that stops a process of printing the print data.

13. An image forming method comprising:

ejecting ink onto a recording sheet through a plurality of orifices of a full line recording head, which is aligned in a width direction substantially perpendicular to a transport direction of the recording sheet, in accordance with print data to be printed in response to a print instruction, thereby printing an image;

dividing, in the width direction of the recording sheet, a print region of the recording sheet into a user region and a print control region, the print data being printed in the user region, print control information being printed in the print control region, the print control information being referred to in post-processing of the recording sheet; and preparatorily ejecting, before printing of the image, ink onto the recording sheet through the plurality of orifices so that an amount of ink ejected through an orifice for the print control region among the plurality of orifices is smaller than an amount of ink ejected through an orifice for the user region among the plurality of orifices.

14. A non-transitory computer readable medium storing a program causing a computer to execute a process for forming an image, the process comprising:

ejecting ink onto a recording sheet through a plurality of orifices of a full line recording head, which is aligned in a width direction substantially perpendicular to a transport direction of the recording sheet, in accordance with print data to be printed in response to a print instruction, thereby printing an image;

dividing, in the width direction of the recording sheet, a print region of the recording sheet into a user region and a print control region, the print data being printed in the user region, print control information being printed in the print control region, the print control information being referred to in post-processing of the recording sheet; and preparatorily ejecting, before printing of the image, ink onto the recording sheet through the plurality of orifices so that an amount of ink ejected through an orifice for the print control region among the plurality of orifices is smaller than an amount of ink ejected through an orifice for the user region among the plurality of orifices.

* * * * *